United States Patent [19]

Alphenaar

[11] Patent Number: 4,945,798

[45] Date of Patent: Aug. 7, 1990

[54] PUNCH KNIFE

[76] Inventor: Gerrit Alphenaar, Watermolenstraat 39, 1551 BB Westzaan, Netherlands

[21] Appl. No.: 327,869

[22] Filed: Mar. 23, 1989

[30] Foreign Application Priority Data

Mar. 23, 1988 [NL] Netherlands ..... 8800717

[51] Int. Cl.[5] ..... B26F 1/46

[52] U.S. Cl. ..... 83/652; 76/107.8; 83/684

[58] Field of Search ..... 83/652–657, 83/694, 699, 781, 696; 76/107 A, 107 C; 30/346.61, 346.54, 350, 351

[56] References Cited

U.S. PATENT DOCUMENTS

| | | | |
|---|---|---|---|
| 3,170,358 | 3/1962 | Martin | 76/107 C |
| 3,373,643 | 2/1966 | Spengler | 83/652 |
| 4,729,274 | 3/1988 | Marbach | 76/107 C |
| 4,825,740 | 5/1989 | Mucci, Sr. | 76/107 C X |

*Primary Examiner*—Frank T. Yost
*Assistant Examiner*—Kenneth E. Peterson
*Attorney, Agent, or Firm*—Pollock, Vande Sande & Priddy

[57] ABSTRACT

A punch knife is formed by a steel band which is provided with a hardened cutting edge and at least one array of perforations and/or a tempered or porous strip of material extending in parallel with the cutting edge.

19 Claims, 1 Drawing Sheet

PUNCH KNIFE

The present invention relates to a punch knife, formed by band steel with a hardened cutting edge.

Such a punch knife is known and is intended for cutting out pieces of any shape from synthetic material, rubber, paper, cardboard and the like.

To manufacture the punch knife a wooden supporting plate of for instance 18 mm thick multiplex is applied and in which, with use of a jig saw or a laser, slits or cuts are made, in which the band steel punch knife is introduced and which is then kept in place within the supporting plate. At the front side of the supporting plate the cutting edge of the punch knife protrudes, while at the back side of the supporting plate the back edge of the punch knife is substantially flush with the supporting plate and is intended to come into abutment at work with the hardened apparatus plate of a thickness of about 1 mm which, in general, is supported under insertion of a paper leaf by the frame, or by the platen of the cutting apparatus.

When inserting the band steel punch knife into the usually curvely extending slits and cuts of the supporting plate, differences in height of the cutting edge of the punch knife in respect to the therewith cooperating cutting plate in the cutting machine generally appear; which unfavorably influences the cutting action of the cutting form.

It therefor is often necessary to apply corrections, which as a rule consist out of that between the apparatus plate, on which the back edge of the punch knife has been retained, and the machine part of the cutting apparatus, supporting this apparatus plate, such as the frame or the platen of the cutting apparatus, paper strips are applied with which the differences in height of the cutting edge of the band steel punch knife in respect to the cooperating cutting plate, are eliminated. This correcting of the differences in height of the cutting edge of the punch knife in respect to the cutting plate is a very accurate and time-consuming work.

The invention aims to obviate this drawback of the known band steel punch knife.

SUMMARY OF THE INVENTION

According to a feature of the punch knife according to the invention, the cutting edge in respect to the cutting plate for the support of the material to be cut out, is to that end self-adjustable.

According to a further feature of the punch knife according to the invention, the band steel has been provided with one array of perforations extending parallel with the cutting edge.

By the presence of these perforations it is achieved, that at that location the band steel may be pressed together, such, that by the differences in pressure-load along the cutting edge of the punch knife, the perforations at the locations of the greater pressure-loads on the cutting edge will be compressed, while the perforations at the locations of the lesser pressure-loads exercised on the cutting edge will be compressed less or not at all, such that an equalization is obtained along the complete length of the cutting edge in the cutting form.

According to an embodiment of the invented punch knife this is provided with at least one tempered or porous strip of material, extending parallel with the cutting edge. Also hereby it counts that with the appearing of differences in pressure along the cutting edge, the higher pressures on the cutting edge make the tempered or porous strip of material more pressed together than such is the case with occuring lower pressures on the cutting edge.

The array of perforations or the tempered or porous strip of material may be applied in the band steel of the punch knife in several places.

In a preferred embodiment of the punch knife according to the present invention, the array of perforations or the tempered or porous strip of material is located at a distance of 0,2 mm up to 6 mm and more in particular at a distance of 3 mm from the cutting edge.

In another practical embodiment of the invented punch knife, at least two arrays of perforations are provided, and are staggered with respect to each other over the half distance or the half pitch between two succeeding perforations.

In a further embodiment of the punch knife according to the invention, the perforations have a long-stretched shape, which extends parallel with the cutting edge. Making the perforations or forming the tempered or porous strip of material in the band steel of the punch knife according to the invention, may take place in several ways. Preferably it takes place by using a laser.

In a preferable embodiment of the punch knife according to the present invention, the perforations have a length of about 2 mm extending parallel with the cutting edge, and a height perpendicular thereon of about 0.15 mm. Further the distance between two succeeding perforations can have a value of 0.5 mm up to 1 mm, more in particular of 0.8 mm.

The present invention will now be explained more closely with reference to the drawing of an embodiment by way of example.

DESCRIPTION OF THE PREFERRED EMBODIMENT(S)

Figure 1:
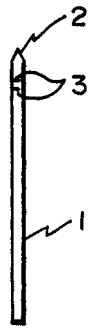
FIG. 1 is a section in enlarged scale perpendicular to the cutting edge of the punch knife according to the present invention.
Figure 2:
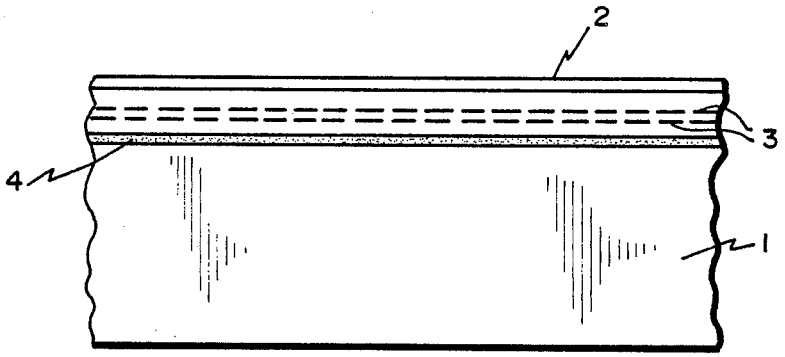
FIG. 2 is a side view of the punch knife according to FIG. 1.

As shown in the drawing, the punch knife 1 has a cutting edge 2, which has been hardened in a known way. The punch knife has been provided with two arrays of long-stretched slit-shaped perforations 3, or a strip of porous or tempered material 4. The perforations are staggered in respect to each other and extending parallel with the cutting edge 2, in which the mutual distance of both the arrays is about 1 mm, while each perforation has a length of 2 mm extending parallel to the cutting edge, and a height perpendicular to the cutting edge of 0.5 mm.

Further the mutual distance, in this example of an embodiment, between two succeeding perforations of an array is 0.9 mm.

Because of the slit-shaped perforations 3 the material may, with the exceeding of a certain cutting edge loading, at that spot be pressed together, by which then the differences in height of the cutting edge 2 are eliminated and thus the punch knife adjusts itself.

I claim:

1. A punch knife comprising:

a steel band with a hardened cutting edge and a bottom edge; and a compressible zone provided in said steel band, said compressible zone extending below said cutting edge and substantially parallel thereto and at a distance from said bottom edge, said compressible zone allowing for self-adjustment of the cutting edge with respect to a cutting plate supporting material to be cut, along the length of the cutting edge.

2. A punch knife according to claim 1, wherein said zone includes at least one array of perforations extending in parallel with the cutting edge.

3. A punch knife according to claim 1, wherein said zone includes at least one tempered or porous strip of material extending in parallel with the cutting edge.

4. A punch knife according to claim 2, wherein said at least one array of perforations is provided at a distance between about 0.2mm up to 6mm from the cutting edge.

5. A punch knife according to claim 2, wherein at least two arrays of perforations are provided which are staggered with respect to each other.

6. A punch knife according to claim 2, wherein said perforations have a long-stretched shape which extends in parallel with the cutting edge.

7. A punch knife according to claim 2, wherein said perforations are formed by a laser.

8. A punch knife according to claim 2, wherein said perforations have a length of about 2mm extending in parallel with the cutting edge and at a height perpendicular thereto of about 0.1mm up to 0.5mm.

9. A punch knife according to claim 2, wherein the distance between two succeeding perforations is from about 0.5mm up to about 1mm.

10. A punch knife according to claim 2, wherein said array of perforations is provided at a distance of about 3mm from the cutting edge.

11. A punch knife according to claim 2, wherein at least two arrays of perforations are provided, which are staggered with respect to each other over half of the distance between two succeeding perforations.

12. A punch knife according to claim 11, wherein said perforations have a long-stretched shape which extends in parallel with the cutting edge.

13. A punch knife according to claim 5, wherein the perforations have a long-stretched shape which extends in parallel with the cutting edge.

14. A punch knife according to claim 3, wherein said tempered or porous strip of material is formed by a laser.

15. A punch knife according to claim 3, wherein said tempered or porous strip of material is provided at a distance of about 3mm from the cutting edge.

16. A punch knife according to claim 7, wherein said perforations have a length of about 2mm extending in parallel with the cutting edge and a height perpendicular thereto of about 0.1mm up to 0.5mm.

17. A punch knife according to claim 1, wherein said compressible zone includes an array of perforations and wherein the distance between two succeeding perforations is about 0.8mm.

18. A punch knife according to claim 4, wherein the distance between two succeeding perforations is 0.5 mm up to 1 mm.

19. A punch knife according to claim 2, further comprising at least one tempered or porous strip of material extending in parallel with the cutting edge.

* * * * *